US005183727A

United States Patent [19]

Schmittou et al.

[11] Patent Number: 5,183,727

[45] Date of Patent: Feb. 2, 1993

[54] COLOR PHOTOGRAPHIC RECORDING MATERIAL PROCESSING

[75] Inventors: Eric R. Schmittou; Allan F. Sowinski, both of Rochester, N.Y.

[73] Assignee: Eastman Kodak Company, Rochester, N.Y.

[21] Appl. No.: 747,895

[22] Filed: Aug. 19, 1991

[51] Int. Cl.[5] ..... G03C 5/38

[52] U.S. Cl. ..... 430/372; 430/428; 430/429; 430/567; 430/455

[58] Field of Search ..... 430/455, 459, 453, 460, 430/567, 372, 428, 429

[56] References Cited

U.S. PATENT DOCUMENTS 2,195,405 4/1940 Brubaker ..... 430/455
4,434,226 2/1984 Wilgus et al. ..... 430/567

OTHER PUBLICATIONS

G. I. P. Levenson, in "The Theory of the Photographic Process", 4th Edition, T. H. James, ed., Macmillan, New York, 1977, pp. 437–444 and references therein.
D. B. Alnutt, *J. Soc. Mot. Pict. Eng.*, 41, 300 (1943).
W. Jaenicke, *Z. Phys. Chem.*, 195 (1/2), 88 (1950).
I. B. Blyumberg, V. G. Ivanova, A. E. Neyman, and M. Ya. Pikus, *Zuhr. Nauch. Priklad. Fot. Kinemat.*, 6, 39 (1961). . Nauch. Priklad. Fot. Kinemat., 6, 39 (1961).
D. C. Shuman and F. Grum, *Photgr. Sci. Eng.*, 11, 249 (1967).
M. Kulanek and H. Hahnel, *Z. Wiss. Photogr.*, 63, 75 (1969).
M. R. V. Sahyun, *Photogr. Sci. Eng.*, 17, 171 (1973).
G. I. P. Levenson and D. G. O'Keeffe, *J. Photogr. Sci.*, 24, 125 (1976).

*Primary Examiner*—Charles L. Bowers, Jr.
*Assistant Examiner*—Mark F. Huff
*Attorney, Agent, or Firm*—Sarah M. Roberts

[57] ABSTRACT

A method of processing a color negative photographic recording material containing tabular grain silver halide emulsion units wherein the fixing agent comprises an aqueous solution of thiosulfate with low ammonium concentration. The silver halide emulsion in at least one of the units comprises grains having a tabularity of between about 50 and 25,000. The photographic recording material has a silver coverage of less than about 7.0 $g/m^2$, and an iodide coverage of less than about 0.35 $g/m^2$. The fixing bath has an ammonium concentration of less than about 1.2 molar, and ammonium may be absent entirely.

7 Claims, No Drawings

COLOR PHOTOGRAPHIC RECORDING MATERIAL PROCESSING

FIELD OF THE INVENTION

This invention relates to the processing of color negative photographic recording materials. More particularly, it relates to the fixing of such materials using a thiosulfate fixing agent that contains low concentrations of ammonium, e.g. a fixing agent in which ammonium is substantially absent.

BACKGROUND OF THE INVENTION

The basic image-forming process of color photography comprises the exposure of a silver halide photographic recording material to light, and the manifestation of a usable image by the wet, chemical processing of the material. The fundamental steps of this processing entail, first, treatment of the recording material with a color developer wherein some or all of the silver halide is reduced to metallic silver while an organic dye is formed from the oxidized developer, and, second, the removal of residual silver halide and metallic silver by the post-development steps of bleaching and fixing. Herein, metallic silver is first oxidized by an oxidant in the bleach, and the silver ion derived from the bleach as well as the residual silver halide are converted to a soluble silver complex by the action of the fixing agent, and it is dissolved away.

It is highly desirable to process a photographic recording material as rapidly as feasible, and an accelerated process——a shortened process compared to ones known in the art——is highly desired. In particular, shortening the silver removal step, which consumes almost half of the total process time, appears to be an attractive manner in which to shorten the overall processing time.

Juxtaposed to the desire for an accelerated process is the desire for, and the need for, photographic recording materials and process solutions that require lower chemical usage and that generate less polluting chemical waste. Used or spent fixer baths are desilvered by electrochemical means to recover the semi-precious metal, but these solutions may still contain ingredients that limit their direct discharge into public waste water streams. Further treatment of these effluent, desilvered fixers may be required for them to conform to standards for environmentally acceptable disposal. In some photographic processes, higher processing speed can be traded for indirect advantage, in the form of lower processing chemistry usage and lower processing waste per unit of photographic material processed. Thus, these desires or goals are interrelated.

A wide variety of fixing agents and silver solvents are known. Such materials form relatively stable and soluble reaction products with silver ion or with silver halides. Such agents include, for example, alkali metal and ammonium thiosulfates, thiocyanate salts, sulfites, cyanides, ammonia and other amines, imides as described in U.S. Pat. No. 2,857,274, thiols as described in U.S. Pat. Nos. 3,772,020 and 3,959,362, thioureas, thioacids, and thioethers as described in German Offen. 2,037,684 and U.S. Pat. Nos. 2,748,000 and 3,033,765, phosphines as described in U.S. Pat. No. 3,954,473, and concentrated halide solutions as described in U.S. Pat. No. 2,353,661.

Examples of fixer bath formulations comprising such fixing agents are many, and may be found in Encyclopedia of Practical Photography, Vol. 6, Eastman Kodak Co., ed., Amphoto, Garden City N.Y., pp. 1086–1091; Photographic Processing Chemistry, Focal Press, London, 1966; Processing Chemical and Formulas, Publication J-1, Eastman Kodak Co., 1973; Photo-Lab Index, Lifetime Edition, Morgan and Morgan, Inc., Dobbs Ferry, N.Y., 1987; and Imaging Handbook of Photography and Reprography Materials, Processes, and Systems, Van Nostrand Reinhold Co., 7th Ed., 1977. Fixer bath formulations may also be found in the references cited in *Research Disclosure*, Item No. 308119, December 1989, pp. 1010.

Thiosulfate salts are generally preferred as fixing agents because they are inexpensive, highly water soluble, non-toxic, non-odorous, and stable over a wide pH range in the fixer bath. Furthermore, thiosulfate salts form very stable, water soluble reaction products with both silver ion and with silver halides. In addition, these soluble reaction products remain stable under the more dilute conditions of subsequent washing or stabilizing steps of the processing operation, thereby preventing reprecipitation of the silver salts in the film. Lastly, these thiosulfate salts are relatively inert toward the organic photographic image dyes and the gelatin that comprise color photographic recording materials.

It is well appreciated in the art that the aforementioned benefits of thiosulfate fixers are even enhanced in the presence of ammonium ion. Fixer baths containing ammonium thiosulfate are more active and solubilize silver halide in a photographic recording material more rapidly than thiosulfate salts of other cations, such as sodium thiosulfate or potassium thiosulfate. It is appreciated that adding ammonium salts to sodium thiosulfate fixer baths increases the rate of fixing. Thus, owing to its rapid fixing action, ammonium thiosulfate is widely used as a photographic fixing agent.

Ammonium ion is, however, an environmentally detrimental, polluting chemical. The concentration of ammonium in waste water effluent streams is regulated in certain locales, and the allowable limits will likely decrease in the future. Therefore it is desirable to produce a fixing bath that has lower concentrations of ammonium, or that has no ammonium whatsoever, in order to reduce or completely eliminate its contribution to photographic effluent pollution.

If the fixability of the color photographic recording material could be improved, it would be possible to reduce the fixer bath ammonium content and make its effluent less polluting, without increasing the fixing time.

It is appreciated in the art that lowering the silver halide coverage of a photographic recording material will increase its rate of fixing. It is also appreciated in the art that lowering the iodide coverage of a silver bromoiodide photographic recording material will increase its rate of fixing. However, both of the aforementioned methods generally produce inferior quality in the resultant photographic recording material. The unrelenting demands for improved granularity in modern films result in use of high coverages of silver halide emulsions, such that any meaningful silver coverage reduction will in turn increase the film's graininess. Likewise, in the design of practical silver bromoiodide emulsions for color negative systems, it is already desirable to minimize iodide content to maximize emulsion developability and contrast. Further reduction of the iodide content of such silver bromoiodide emulsions typically compromises emulsion quantum efficiency unacceptably, resulting in inferior sensitivity for a given granularity performance.

A very useful way to reduce emulsion granularity for a given speed is by the careful adjustment of emulsion morphology. Employment of high aspect ratio tabular silver halide emulsions, as described in U.S. Pat. Nos. 4,439,520, 4,672,027, and 4,693,954, has succeeded in providing a large variety of advantages to color negative photographic recording materials. Such advantages include improved speed-granularity relationships, increased photographic sensitivity, higher contrast for a given degree of grain size dispersity, higher separations of blue and minus blue speeds, less image variance as a function of processing time and/or temperature variances, the capability of optimizing light transmittance or reflectance as a function of grain thickness, and reduced susceptibility to background radiation or airport x-ray radiation damage in very high speed emulsions.

These interdependent problems of providing a color negative photographic recording material with low granularity, as well as other desirable features of photographic performance, and lower chemical waste per unit of film processed (or alternatively, an accelerated fixing process) would be ameliorated if a photographic material of improved fixability could be utilized, particularly with a fixer bath of improved environmental acceptability.

One approach to improve photographic recording material fixability is to employ fixing accelerating agents either in the fixer bath or in the recording material itself. Compounds which promote or increase the rate of fixing are known, and can be added to the fixing bath. Examples of such fixing promoters are described in Chapter 15 of "The Theory of the Photographic Process", 4th Edition, T. H. James, ed., Macmillan, N.Y., 1977. Such substances include ammonium salts, such as ammonium chloride, ethylenediamine, guanidine, other amines and their salts such as pyridinium and piperidinium salts. Thiourea is also mentioned as a fixing promoter. Many of these compounds are useful only at high concentrations, or they have toxic properties (such as the ammonium ion and amine salts) which make them inappropriate for improved process ecology.

U.S. Patent 4,812,391 seeks faster fixing speed by the utilization of photographic recording materials containing a polymer capable of providing a cation site on the same side of an emulsion layer in a fixing bath. However, there is no indication that incorporated coupler color recording materials obtain satisfactory sensitivity, contrast, and stability in the presence of these polymers, or that adequate fixability is conferred by the presence of these polymers in this instance.

U.S. Pat. No. 4,695,529 describes an image forming process comprising a color photographic material containing tabular silver halide grain emulsions and subjecting the photographic material to color development processing, and then processing said material in a bath having bleaching ability and successively in a bath having bleach-fixing ability. Reduction of ammonium ion content or usage to obtain adequate fixing and lessen the polluting qualities of spent fixer baths is not indicated.

There remains a need for an image forming process comprising a color negative photographic recording material of improved fixability without sacrificing photographic performance and fixer baths that reduce the ammonium ion content of their effluent.

SUMMARY OF THE INVENTION

The present invention provides a color negative image forming process that yields a high quality image with improved environmental acceptability for the fixer bath effluents.

The present invention also increases the fixability of the incorporated coupler color photographic recording material.

The present inventors have surprisingly found that when certain silver halide emulsions are used, the fixability of a color photographic recording material is improved, without necessarily reducing silver coverage or iodide content that would result in a sacrifice of sensitivity or graininess, and without the need of special fixing accelerating agents. Furthermore, it has also been discovered that these emulsions most effectively improve fixer bath performance as the ammonium ion content of the fixer bath is reduced or eliminated entirely, allowing fixing speed that may equal or be better than that of currently available color negative materials in the ammonium thiosulfate fixers of the current art. Thus the instant invention provides reduction of or elimination of the ammonium from the fixing bath without sacrifice in access time, and yields a more environmentally attractive fixer bath residue for disposal.

DETAILED DESCRIPTION OF THE INVENTION

Thus, in one embodiment, this invention provides an image forming process for use with a color negative recording material comprising a support and at least one high tabularity silver halide emulsion unit sensitive to light, wherein:

(a) the unit contains from 0.2 to 3.0 g/m$^2$, based on silver, of a silver halide emulsion wherein greater than 50% of the projected area of the grains is provided by tabular grains having a tabularity of between 50 and 25,000;

(b) the unit has an iodide content between 0 and 40 mole percent;

(c) the color recording material has a silver content of less than about 7.0 g/m$^2$;

(d) the color recording material has an iodide content of less than about 0.35 g/m$^2$;

said process comprising subjecting the exposed color photographic recording material to color development processing, then bleaching, and then fixing the photographic recording material in a fixer bath having a thiosulfate concentration from about 0.05 to about 3.0 molar, and wherein the ammonium concentration is less than about 1.2 molar. The process of this invention is of interest to, and readily adaptable by industry.

In the material which follows, and above, "square meter" is designated by "m$^2$" or "m$^2$".

The color negative photographic recording materials to which this invention relates typically have a contrast (gamma) of 0.9 or less, that is positive in sign. Exposure latitude and contrast are defined and measured as described in Strobel et al., *Photographic Materials and Processes*, pp. 46–50, Focal Press, Boston, 1986.

The results observed with the present invention contradict the expectation that lowering the fixer ammonium ion concentration, even to the point of eliminating ammonium entirely, would substantially decrease the rate of fixing of a color photographic recording material. Moreover, the use of lower ammonium concentration, and preferably no ammonium at all, reduces the undesirable wastes in the processing effluent, and makes the spent fixer more suitable for environmentally acceptable waste disposal following desilvering. The improved fixability of the color photographic recording material alternatively allows a decrease in the access time to the processed image when lowered levels of ammonium are employed, still providing improved process ecology, even when high silver coverages are employed. And with high silver coverages of the present high tabularity silver halide emulsions, improvements in graininess are realized, while the process ecology benefit is realized.

When lower coverages of these tabular silver halide grains are employed, the process ecology can be further improved by further lowering of the fixer bath ammonium or by its complete elimination, or the process access time could be further decreased in the presence of the reduced ammonium levels of the present invention, albeit at the expense of graininess. The use of less silver results in the use of less gelatin, and contributes to the thinning of the photographic recording material, and produces lowered material costs. Moreover, the thinner units containing reduced silver levels can lead to reduced consumption of processing chemicals, notably the fixing agent itself, thereby also reducing the cost of disposing of the waste effluent chemicals that result from processing.

The tabular grain silver halide emulsions that are useful in the present invention can be comprised of silver bromide, silver chloride, silver iodide, silver chlorobromide, silver chloroiodide, silver chlorobromoiodide, silver bromoiodide, or mixtures thereof. These emulsions include (i) high aspect ratio tabular grain emulsions and (ii) thin intermediate aspect ratio tabular grain silver halide emulsions. High aspect ratio tabular grain emulsions are those which exhibit an average aspect ratio of greater than 8:1. Thin, intermediate aspect ratio emulsions are those in which the tabular grains have an average thickness of less than 0.2 μm and an average aspect ratio ranging from 5:1 to 8:1. Such emulsions are disclosed by Wilgus et al U.S. Pat. No. 4,434,226, Daubendiek et al U.S. Pat. No. 4,414,310, Wey U.S. Pat. No. 4,399,215, Solberg et al U.S. Pat. No. 4,433,048, Mignot U.S. Pat. No. 4,386,156, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,643,966 and Daubendiek et al U.S. Pat. Nos. 4,672,027 and 4,693,964. Also specifically contemplated for use with this invention are those silver bromoiodide grains with a higher molar proportion of iodide in the core than in the periphery of the grain, such as those described in GB 1,027,146; JA 54/48,521; U.S. Pat. No. 4,379,837; U.S. Pat. No. 4,444,877; U.S. Pat. No. 4,665,614; U.S. Pat. No. 4,636,461; EP 264,954; and U.K. patent application numbers 8916041.0 and 8916042.8, both filed Jul. 13, 1989, and entitled PROCESS OF PREPARING A TABULAR GRAIN SILVER BROMOIODIDE EMULSION AND EMULSIONS PRODUCED THEREBY. The silver halide emulsions can be either monodisperse or polydisperse as precipitated. The grain size distribution of the emulsions can be controlled by techniques of separation and blending of silver halide grains of different types and sizes, including tabular grains, as previously described in the art, for example, in U.S. Pat. No. 4,865,964, issued Sep. 12, 1989, entitled BLENDED EMULSIONS EXHIBITING IMPROVED SPEED-GRANULARITY RELATIONSHIPS.

The high aspect ratio tabular grain emulsions and the thin intermediate aspect ratio tabular grain emulsions, as well as other emulsions useful in this invention, can be characterized by a relationship called "tabularity", ($\overline{T}$), which is related to aspect ratio (AR). This relationship can be defined by the following equations:

$$AR = \frac{ecd}{t} \quad (1)$$

$$T = \frac{AR}{t} = \frac{ecd}{t^2} \quad (2)$$

where ecd is the average equivalent circular diameter of the tabular grains, and t is the average thickness of the tabular grains, where dimensions are measured in micrometers.

Tabular grains are those having two substantially parallel crystal faces, each of which is substantially larger than any other single crystal face of the grain. The term "substantially parallel" as used herein is intended to include surfaces that appear parallel on direct or indirect visual inspection at 10,000 × magnification.

The grain characteristics described above of the silver halide emulsions of this invention can be readily ascertained by procedures well known to those skilled in the art. The equivalent circular diameter of the grain is defined as the diameter of a circle having an area equal to the projected area of the grain as viewed in a photomicrograph, or an electron micrograph, of an emulsion sample. From shadowed electron micrographs of emulsion samples it is possible to determine the thickness and the diameter of each grain as well as the tabular nature of the grain. From these measurements the average thickness, the average ecd, and the tabularity can be calculated.

The projected areas of the tabular silver halide grains meeting the tabularity criteria can be summed. The projected areas of the remaining silver halide grains in the photomicrograph can be separately summed. From the two sums the percentage of the total projected area of the silver halide grains provided by the tabular grains meeting the tabularity criteria can be calculated.

Good results are obtained when the tabular grain emulsion has a tabularity of from 50 to 25,000;

preferred are elements in which at least one of the emulsions has a tabularity of from 100 to 10,000; and especially preferred are elements that employ an emulsion with a tabularity of from 100 to 2,500.

As used herein, the term "imaging unit" or "unit" refers to all of the layers in the element intended to record radiation in a given region of the spectrum and form a corresponding dye image. It will be appreciated that each imaging unit can be comprised of one or more silver halide emulsion layers sensitive to the same region of the spectrum. It is common with high speed color negative materials of the type to which this invention relates, for each unit to be composed of 2 or 3 layers, which can be adjacent or not. At least one of the layers in the unit is, as indicated above, comprised of a silver halide emulsion in which greater than 50% of the projected area is provided by silver halide grains having a tabularity of 50 to 25,000. Preferably, if the unit is comprised of more than one layer, this emulsion is in the most sensitive of the layers, although other of the layers, or all of the layers, can be comprised of an emulsion with a tabularity of 50 to 25,000. The emulsion(s) employed in the other layer(s) can be a non-tabular emulsion or a tabular emulsion that does not satisfy the tabularity criteria enumerated above so long as the projected area criterion for the unit is satisfied. If desired, other silver halide emulsions can be blended with the high tabularity emulsion, so long as the projected area criterion is satisfied.

The silver halide in these other emulsions can be comprised of silver bromide, silver chloride, silver iodide, and mixtures of halides such as silver bromoiodide, silver chlorobromide and silver chlorobromoiodide. Especially preferred silver halides, for all of the emulsions in the element, are silver bromoiodides and silver bromide. Most preferred proportions of iodide are from 3 to 12 mole percent although lesser or greater (up to the limit of iodide solubility in bromide) proportions of iodide can be used. A preferred general range is 0–40 mole percent as mentioned above. When mixed halides are used in the emulsion grain, the proportions of the halide can be uniform throughout the grain, or the proportions can vary continuously or discontinuously across the diameter of the grain, as in core-shell or multiple structure grains.

The amount of silver halide in the imaging unit of this invention is from 0.2 to 3.0 g/m$^2$, based on silver. When the color photographic recording unit has two or more silver halide layers of different sensitivities to the same region of the visible spectrum it is preferred that the more sensitive layer comprise from about 0.10 to about 2.2 g/m$^2$ of silver, and the less sensitive layer or layers comprise sufficient silver to meet the total unit imaging requirement and total film silver requirement noted above. Preferably, the more sensitive layer can comprise from about 0.20 to about 1.6 g/m$^2$ of silver.

As is typical of color negative materials, the photographic elements of this invention preferably contain a development inhibitor releasing coupler, especially in the higher speed layer of a given unit. Typical DIR couplers are described in U.S. Pat. Nos. 3,148,062; 3,227,554; 3,617,291; 4,095,984; 4,248,962; 4,409,323; 4,477,563; and 4,782,012.

Inasmuch as improvements in photographic performance become more difficult to achieve as the speed of the material is increased, the advantages of this invention are particularly applicable to the higher speed materials, i.e. 100 ISO and greater. The advantages become especially significant for materials having speeds of 400 to about 6400 ISO.

Preferred photographic recording materials of this invention are multicolor color elements that contain dye imaging units sensitive to different regions of the electromagnetic spectrum. Each unit can be comprised of a single silver halide emulsion layer or of multiple emulsion layers sensitive to a given region of the spectrum. The layers of the element, including the layers of the image-forming units, can be arranged in various orders as is known in the art, for example, from U.S. Pat. Nos. 4,400,463 and 4,599,302.

Typically the element comprises imaging units that yield a cyan, magenta and yellow dye image and the silver halide associated with each unit is sensitized to the complementary region of the electromagnetic spectrum. However, one or more of the silver halide layers can be false sensitized to a region of the spectrum that is not the complement of the dye produced by the coupler with which it is associated. For example, one, two, or three of the imaging units can be sensitized to different portions of the infrared region of the spectrum.

At least one of the imaging units of the element is an imaging unit having the characteristics defined above. It is preferred that this unit be a magenta dye-forming unit or a cyan dye forming unit since the visual information provided by each of these units is of greater significance than that provided by the yellow dye forming unit. In another preferred embodiment, both of these imaging units have the characteristics described above.

A typical multicolor photographic recording material comprises a support bearing a cyan dye image-forming unit comprising at least one red-sensitive silver halide emulsion layer having associated therewith at least one cyan dye-forming coupler, a magenta image forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. In addition to the coupler that forms a dye complementary to the sensitization of the associated silver halide emulsion, the layer can contain one or more non-complementary couplers in order to modify perceived photographic performance. The recording material is coated on a support and can contain additional layers, such as filter layers, image modifier layers, interlayers, overcoat layers, subbing layers, and the like.

In the following discussion of suitable materials for use in the recording materials employed in this invention, reference will be made to *Research Disclosure,* December 1978, Item 17643, published by Kenneth Mason Publications, Ltd., Dudley Annex, 12*a* North Street Emsworth Hampshire P010 7DQ, ENGLAND, and to *Research Disclosure,* December 1989, Item 308119, the disclosures of which are incorporated herein by reference. This publication will be identified hereafter by the term "Research Disclosure".

Sensitizing compounds, such as compounds of copper, thallium, lead, bismuth, cadmium, selenium, iridium and other Group VIII noble metals, can be present during precipitation of the silver halide emulsions.

The silver halide emulsions can be chemically sensitized. Noble metal (e.g., gold), middle chalcogen (e.g., sulfur, selenium, or tellurium), and reduction sensitizers, employed individually or in combination, are specifically contemplated. Typical chemical sensitizers are listed in *Research Disclosure,* Item 17643, and Item 308119, cited above, Section III. The chemical sensitization can be accomplished in the presence of finish modifiers such as those described in U.S. Pat. No. 4,578,348.

The silver halide emulsions can be spectrally sensitized with dyes from a variety of classes, including the polymethine dye class, which includes the cyanines, merocyanines, complex cyanines and merocyanines (i.e., tri-, tetra-, and poly-nuclear cyanines and merocyanines), oxonols, hemioxonols, styryls, merostyryls, and streptocyanines. Illustrative spectral sensitizing dyes are disclosed in *Research Disclosure,* Item 17643, and Item 308119, cited above, Section IV.

Suitable vehicles for the emulsion layers and other layers of elements are described in *Research Disclosure* Item 17643, and Item 308119, Section IX and the publications cited therein.

Useful couplers can be polymeric or nonpolymeric. Typical cyan dye forming couplers that are useful in this invention are phenols and naphthols. Typical magenta dye forming couplers are pyrazolones and pyrazoloazoles. Typical yellow dye forming couplers are acetoacetanilides and benzoylacetanilides. Such dye image-forming couplers, which can be of the one, two or four equivalent type and can be coated in or adjacent to silver halide emulsion layers to be free to react with oxidized developing agent to form the desired image. Minor amounts of couplers which form different colored images may be incorporated within the dye forming units. For example, the addition of a small amount of a cyan coupler to a magenta dye forming layer will alter the hue of the resulting magenta image. In addition, the imaging unit can contain image modifying couplers and compounds which release development inhibitor moieties, development accelerator moieties or bleach accelerating moieties. These moieties are released from such compounds, or from a timing group contained within such compounds, as the result of processing.

The photographic recording materials of this invention can contain brighteners (*Research Disclosure* Section V), antifoggants and stabilizers (*Research Disclosure* Section VI), antistain agents and image dye stabilizers (*Research Disclosure* Section VII, paragraphs I and J), light absorbing and scattering materials (Research Disclosure Section VIII), hardeners (*Research Disclosure* Section XI), plasticizers and lubricants (*Research Disclosure* Section XII), matting agents (*Research Disclosure* Section XVI) and development modifiers (*Research Disclosure* Section XXI). The photographic materials can have incorporated therein developing agents to render them suitable for activation processing as described in U.S. Pat. No. 3,342,599.

The photographic recording materials can be coated on a variety of supports as described in *Research Disclosure* Section XVII and the references described therein.

Photographic recording materials can be exposed to actinic radiation, typically in the visible region of the spectrum, to form a latent image as described in *Research Disclosure* Section XVIII and then processed to form a visible dye image as described in *Research Disclosure* Section XIX. Processing to form a visible dye image includes the step of contacting the element with a color developing agent to reduce developable silver halide and oxidize the color developing agent. Oxidized color developing agent in turn reacts with the coupler to yield a dye.

For the development and bleaching of the photographic recording material of the invention, the processing steps of common color negative film processes such as the C-41 amateur negative process or the ECN-2 motion picture film process are contemplated. A representative process is described in the 1988 Annual of the British Journal of Photography, pages 196-198.

The advantages of this invention are realized by processing the described color photographic recording material of improved fixability with a fixer bath that contains thiosulfate, and that 2) contains a low concentration of ammonium, or contains no or substantially no ammonium. For purposes of this invention, "substantially no ammonium" signifies the absence of ammonium intentionally added to the fixer formulation or intentionally added to a solution used to replenish the fixer during processing. Ammonium ion or other ammonium species (collectively called "ammonium") which unintentionally occur as impurities, or which are carried into the fixer bath by color photographic recording material, may be present in the fixer.

The thiosulfate is present at a concentration from about 0.05 molar to about 3.0 molar and the ammonium concentration is less than about 1.2 molar. The thiosulfate may be provided by ammonium thiosulfate, sodium thiosulfate, potassium thiosulfate, lithium thiosulfate, magnesium thiosulfate, or calcium thiosulfate, or mixtures of these thiosulfates, provided that the thiosulfate and ammonium concentrations stated above are satisfied. Ammonium from fixer ingredients other than thiosulfate may be present, but the total ammonium concentration of the fixer must be less than about 1.2 molar. As a replacement for ammonium thiosulfate in order to achieve desired thiosulfate concentrations and low ammonium concentrations, sodium thiosulfate is preferred. In its preferred operation the invention would utilize fixer baths that have less than about 0.9 molar ammonium. Most preferably, the ammonium concentration would be below about 0.6 molar.

Other characteristics of the fixer bath are those that are typical of fixer baths in the art. For example, the concentration of thiosulfate in the fixer bath can be from about 0.05 molar to as high as solubility in the processing solution allows, but it is preferred that this concentration be from about 0.05 molar to 3.0 molar. The most preferred concentration of thiosulfate ranges from 0.3 to 1.6 molar. The pH of the fixer bath may range from about 3 to as high as about 12, but it is generally preferred that the pH be between 4 and 10. The fixer bath can optionally contain a source of sulfite or bisulfite ion. If the fixer bath is to be used at a pH below about 7, it is preferred to include a source of sulfite or bisulfite ion in the fixer solution. For example, sodium or potassium sulfite, sodium or potassium bisulfite, or sodium or potassium metabisulfite can be used. The concentration of this source of sulfite or bisulfite ion is generally from about 0.01 molar to about 0.5 molar. To control solution pH, various buffering agents may be used in the fixer bath, including the above-mentioned sulfite or bisulfite sources, acetate salts, citrates, tartrates, borates, carbonates, phosphates, etc.

In addition to thiosulfate and sulfite or bisulfite, the fixer bath can contain one or more other compounds known to be fixing agents. Such compounds include thiocyanate salts, thiourea, amines, and imides. Patent and technical literature references to these and other compounds may be found in Chapter 59 of "Comprehensive Coordination Chemistry", Vol. 6, G. Wilkinson, ed., Pergamon, Oxford, 1987.

If a film hardening action is desired for the fixer bath, it may contain one or more ingredients to effect film hardening and to stabilize the hardening agent in the fixer bath. Such ingredients include potassium alum, aluminum sulfate, aluminum chloride, boric acid, sodium tetraborate, gluconic acid, tartaric acid, citric acid, acetic acid and sodium acetate, for example.

The fixer bath may contain one or more substances which are known to accelerate film fixing. These materials are described in Chapter 15 of "The Theory of the Photographic Process", 4th edition, T. H. James, ed., Macmillan, NY, 1977. Such substances include ammonium salts, such as ammonium chloride (within the content limitations mentioned above), ethylenediamine, and other amines, such as guanidine, which are capable of providing organic ammonium cations that accelerate the fixing process, and thiourea.

The fixer bath may also contain compounds for the prevention of precipitation of metal salts of metals, other than silver, that are initially present in or that become introduced into the fixer bath during use. Such metals include iron, copper, zinc, magnesium, calcium, aluminum, and chromium, among others. Metal sequestering agents, chelating agents, and precipitation control agents may be used to control these metals. Examples of these metal control agents are polycarboxylic acids such as citric acid and tartaric acid; aminocarboxylic acids such as nitrilotriacetic acid, N-methyliminodiacetic acid, ethylenedinitrilotetraacetic acid (EDTA), and diethylenetriaminepentaacetic acid; organophosphonic acids such as nitrilotris(methylenephosphonic) acid and 1-hydroxyethylidene-1,1-diphosphonic acid; orthodihydroxybenzene compounds such as 4,5-dihydroxy-m-benzenedisulfonic acid; acyclic or cyclic polyphosphates; and various polymers such as polyacrylic acids.

The concentrations of the fixer bath constituents during processing can be regulated by the usual controlling factors, namely, fixer replenishment rates and replenishing component concentrations, water losses due to evaporation, evaporative losses of volatile components other than water, the amounts and compositions of processing liquids carried into and out of the fixer bath solution by the photographic recording material, the amount of solution overflow from other vessels containing processing solutions that is introduced into the fixer bath, the amount of solid components carried into the fixer bath by the photographic recording material and then dissolved in the fixer bath, and the rate of removal or replacement of any constituent by means such as ion exchange, electrolysis, electrodialysis, and the like.

Since the fixing step is a separate step in the overall image-forming process, many alternative processing sequences are compatible with the invention. In the processing of color negative photographic recording materials, these sequences would include a development process prior to a bleaching process, which in turn precedes a fixing process. Accomplishing a part or all of the fixing process with a bleach-fixing process, in which a bleaching agent is present in the fixing bath, is contemplated with the invention. The bleaching process can also be accomplished, in total or in part, with a bleach-fixing process. Generally, it is preferred that a stabilization process follow the last fixing process, but this is not required in order to practice the invention. Examples of process sequences contemplated with the invention are as follows:

color development;bleaching;fixing;stabilization
color development;bleach-fixing;stabilization
color development;bleaching;bleach-fixing;stabilization
color development;fixing;bleaching;fixing;stabilization
color development;fixing;bleach-fixing;stabilization
color development;bleach-fixing;fixing;stabilization In these process sequences, at least one of the fixing or bleach-fixing steps is a fixing step of this invention.

Any of the known formulations for the development, bleaching, and stabilization of color negative photographic recording materials may be used with the invention. Any of the known bleaching agents that are useful in thiosulfate bleach-fixing formulations may be used to form a bleach-fixing bath when added to a fixing bath of this invention. Examples of such bleaching agents are the iron(III) complexes of aminocarboxylic acid chelating agents such as ethylenediaminetetraacetic acid, 1,3-diaminopropanetetraacetic acid, and the like.

One or more intervening processing steps may come before the development, bleaching, bleach-fixing, fixing, and/or stabilization steps, such as washing steps. Other examples of modifications to the processing cycle contemplated by the invention include: a pre-bath and/or washing treatment before development; a stop bath and/or washing treatment after the development step; and a bleach accelerator bath and/or washing step before a bleaching step or bleach-fixing step.

The fixing times employed in this invention are not critical. One may use greater or longer fixing times, as desired. In instances where longer fixing times are used, generally speaking the ammonium ion content can be reduced, and the environmental advantages provided by this invention optimized. Thus for example, one may use fixing times of 240 seconds, 480 seconds, or even longer. However, it is preferred to use comparatively short fixing times (less than 270 seconds) in order to have greater processing throughput. Thus it is preferred that fixing times of from about 180 to about 270 seconds be used. Highly preferred fixing times are 120–180 seconds.

The present invention is now illustrated in greater detail by reference to the following examples.

A series of multicolor, incorporated coupler photographic materials were prepared by coating the following layers in the order recited on a cellulose acetate film support.

A first photographic recording material of the invention was prepared by coating the following layers, in order, on a cellulose acetate film support bearing, a layer of black colloidal silver sol at 0.3 g/m$^2$, and gelatin at 2.44 g/m$^2$. All of the silver halide emulsion layers were stabilized with 2.0 grams of 4-hydroxy-6-methyl-1,3,3*a*,7-tetraazaindene per mole of silver contained in the layer. The material was designated Element I. Structures of compounds such as couplers, dyes, UV absorbers and hardener, referred to by letter/number designations in the following description, of photographic elements, are set forth after Element IV (Control) below.

ELEMENT I
INVENTION

Layer 1: Slow Cyan Layer —— comprising a blend of a slower red-sensitized tabular grain silver bromoiodide emulsion (3.9 mole % I−) at 0.19 g/m$^2$ and a faster red-sensitized tabular grain silver halide emulsion (3.9 mole % I−) at 0.19 g/m$^2$, gelatin at 0.97 g/m$^2$, cyan image-forming coupler E at 0.44 g/m$^2$, DIR coupler B at 0.020 g/m$^2$, bleach accelerator releasing coupler D at 0.016 g/m$^2$.

Layer 2: Fast Cyan Layer ——comprising faster red-sensitized tabular silver bromoiodide grains (4.0 mole % I−) at 0.50 g/m$^2$, gelatin at 0.73 g.m$^2$, cyan image-forming coupler E at 0.23 g/m$^2$, DIR coupler B at 0.018 g/m$^2$, and bleach accelerating releasing coupler D at 0.016 g/m$^2$.

Layer 3: Interlayer —— comprising gelatin at 0.65 g/m$^2$, oxidized developer scavenger didodecylhydroquinone at 0.054 g/m$^2$, and permanent dyes YD-1 at 0.129 g,/m$^2$ and MD-1 at 0.086 g/m$^2$.

Layer 4: Slow Magenta Layer —— comprising a blend of slower green-sensitized tabular silver bromoiodide grains (2.4 mole % I−) at 0.23 g/m² and faster green-sensitized tabular silver bromoiodide grains (4.0 mole % I−) at 0.043 g/m², gelatin at 0.61 g/m², image-forming couplers F at 0.18 g/m² and G at 0.24 g/m², and DIR coupler B at 0.011 g/m².

Layer 5: Fast Magenta Layer —— comprising faster green-sensitized tabular silver bromoiodide grains (4.0 mole % I−) at 0.43 g/m², gelatin at 0.64 g/m², image-forming couplers F at 0.045 g/m² and G at 0.058 g/m², and DIR coupler B at 0.016 g/m².

Layer 6: Yellow Filter Layer —— comprising gelatin at 0.65 g/m², Cary Lea silver at 0.022 g/m², and oxidized developer scavenger didodecylhydroquinone at 0.054 g/m².

Layer 7: Slow Yellow Layer —— comprising blue-sensitized tabular silver bromoiodide grains (4.2 mole % I−) at 0.32 g/m², gelatin at 0.97 g/m², image-forming coupler J at 0.78 g/m², DIR coupler K at 0.022 g/m², and bleach accelerator releasing coupler L at 0.022 g(m².

Layer 8: Fast Yellow Layer —— comprising faster blue-sensitized tabular silver bromoiodide grains (3.0 mole % I−) at 0.43 g/m², gelatin at 0.65 g/m², image-forming coupler J at 0.24 g/m², DIR coupler K at 0.011 g/m², and bleach accelerator releasing coupler L at 0.022 g/m².

Layer 9: UV Filter Layer —— comprising gelatin at 0.97 g/m², and UV absorber filter dyes UV-1 at 0.11 g/m² and UV-2 at 0.13 g/m².

Layer 10: Protective Overcoat —— comprising gelatin at 0.54 g/m², unsensitized silver bromide Lippmann emulsion at 0.11 g/m², anti-matte polymethylmethacrylate beads at 0.054 g/m² and hardener H-1 added at 2.0% of total gelatin weight.

A second photographic recording material of the invention with significantly higher silver coverage than the previous example was prepared by coating the following layers, in order, on a cellulose acetate film support bearing a layer of black colloidal silver sol at 0.3 g/m² and gelatin at 2.44 g/m². This material was designated Element II

ELEMENT II
INVENTION

Layer 1: Slow Cyan Layer —— comprising a blend of slower red-sensitized tabular silver bromoiodide grains (3.9 mole % I−) at 0.32 g/m² and faster red-sensitized tabular silver bromoiodide grains (4.0 mole % I−) at 0.54 g/m², gelatin at 1.61 g/m², cyan image-forming coupler A at 0.54 g/m², DIR coupler B at 0.015 g/m², masking coupler C at 0.068 g/m², bleach accelerator releasing coupler D at 0.016 g/m² and antifoggant 4-hydroxy-6-methyl-1,3,3*a*,7-tetraazaindene at 0.014 g/m².

Layer 2: Fast Cyan Layer —— comprising faster red-sensitized tabular silver bromoiodide grains (4.0,mole % I−) at 1.29 g/m², gelatin at 1.56 g/m², bleach accelerator releasing coupler D at 0.016 g/m² cyan image-forming coupler E at 0.22 g/m², DIR coupler B at 0.023 g/m², masking coupler C at 0.029 g/m², and antifoggant 4-hydroxy-6-methyl-1,3,3*a*,7-tetraazaindene at 0.021 g/m².

Layer 3: Interlayer —— comprising gelatin at 0.65 g/m², oxidized developer scavenger didodecylhydroquinone at 0.054 g/m², and permanent dye YD-1 at 0.086 g/m².

Layer 4: Slow Magenta Layer —— comprising a blend of a slower green sensitized tabular grain silver bromoiodide emulsion (3.9 mole % I−) at 0.59 g/m², a faster tabular grain silver bromoiodide emulsion (4.0 mole % I−) at 0.65 g/m², gelatin at 1.88 g/m², image-forming couplers F at 0.043 g/m² and G at 0.39 g/m², DIR coupler B at 0.016 g/m², DIR coupler I at 0.018 g/m², masking coupler H at 0.069 g/m², and antifoggant 4-hydroxy-6-methyl-1,3,3*a*,7-tetraazaindene at 0.018 g/m².

Layer 5: Fast Magenta Layer —— comprising faster green-sensitized tabular silver bromoiodide grains (4.0 mole % I−) at 0.97 g/m², gelatin at 1.51 g/m², image-forming couplers F at 0.075 g/m² and G at 0.032 g/m², DIR coupler I at 0.012 g/m², masking coupler H at 0.017 g/m², and antifoggant 4-hydroxy-6-methyl-1,3,3*a*,7-tetraazaindene at 0.016 g/m².

Layer 6: Yellow Filter Layer —— comprising gelatin at 0.65 g/m², Cary Lea silver at 0.022 g/m², and oxidized developer scavenger didodecylhydroquinone at 0.054 g/m².

Layer 7: Slow Yellow Layer —— comprising blue-sensitized tabular silver bromoiodide grains (4.2 mole % I−) at 0.43 g/m², gelatin at 1.62,g/m², image-forming coupler J at 1.08 g/m², DIR coupler K at 0.048 g/m², bleach accelerator releasing coupler L at 0.022 g/m², and antifoggant 4-hydroxy-6-methyl-1,3,3*a*,7 tetraazaindene at 0.007 g/m².

Layer 8: Fast Yellow Layer —— comprising faster blue-sensitized tabular silver bromoiodide grains (3.0 mole % I−) at 0.81 g/m², gelatin at 1.21 g/m², image-forming coupler J at 0.24 g/m², DIR coupler K at 0.032 g/m², and antifoggant 4-hydroxy-6-methyl-1,3,3*a*,7-tetraazaindene at 0.013 g/m².

Layer 9: Protective Overcoat and UV Filter Layer —— comprising gelatin at 1.22 g/m², unsensitized silver bromide Lippmann emulsion at 0.11 g/m², UV absorber filter dyes UV-1 at 0.11 g/m² and UV-2 at 0.12 g/m², anti-matte polymethylmethacrylate beads at 0.054 g/m² and hardener H-1 added at 2.0% of total gelatin weight.

A third photographic recording material of the invention with still higher silver coverage than the previous examples was prepared by coating the following layers, in order, on a cellulose acetate film support bearing a layer of black colloidal silver sol at 0.3 g/m², and gelatin at 2.44 g/m². This material was designated Element III.

ELEMENT III
INVENTION

Layer 1: Slow Cyan Layer —— comprising a blend of slower red-sensitized tabular silver bromoiodide grains (3.9 mole % I−) at 0.32 g/m² and faster red-sensitized tabular silver bromoiodide grains (4.0 mole % I−) at 0.54 g/m², gelatin at 1.62 g/m², cyan image-forming coupler A at 0.54 g/m², DIR coupler B at 0.011 g/m², masking coupler C at 0.068 g/m², bleach accelerator releasing coupler D at 0.016 g/m² and antifoggant 4-hydroxy-6-methyl 1,3,3*a*,7-tetraazaindene at 0.014 g/m².

Layer 2 Fast Cyan Layer —— comprising faster red-sensitized tabular silver bromoiodide grains (4.0 mole % I−) at 1.29 g/m², gelatin at 1.56 g/m², cyan image-forming coupler E at 0.17 g/m², DIR coupler B at 0.023 g/m², masking coupler C at 0.029 g/m², and antifoggant 4-hydroxy-6-methyl-1,3,3a,7-tetraazaindene at 0.021 g/m².

Layer 3: Interlayer —— comprising gelatin at 0.65 g/m², oxidized developer scavenger didodecylhydroquinone at 0.054 g/m², and permanent dye YD 1 at 0.086 g/m².

Layer 4: Slow Magenta Layer —— comprising a blend of a slower green-sensitized tabular grain silver bromoiodide emulsion (3.9 mole % I−) at 0.86 g/m², a faster tabular grain silver bromoiodide emulsion (4.0 mole % I−) at 0.32 g/m², a second faster tabular grain silver bromoiodide emulsion (3.9 mole % I−) at 0.32 g/m², gelatin at 2.15 g/m², image-forming couplers F at 0.056 g/m² and G at 0.51 g/m², DIR coupler B at 0.016 g/m², DIR coupler I at 0.017 g/m², masking coupler H at 0.069 g/m², and antifoggant 4-hydroxy-6-methyl-1,3,3a,7-tetraazaindene at 0.020 g/m².

Layer 5: Fast Magenta Layer —— comprising faster green-sensitized tabular silver bromoiodide grains (4.0 mole % I−) at 1.29 g/m², gelatin at 1.51 g/m², image-forming couplers F at 0.075 g/m² and G at 0.032 g/m², DIR coupler I at,0.015 g/m², masking coupler H at 0.017 g/m², and antifoggant 4-hydroxy-6-methyl-,1,3,3a,7-tetraazaindene at 0.016 g/m².

Layer 6: Yellow Filter Layer —— comprising gelatin at 0.65 g/m², Cary Lea silver at 0.022 g/m², and oxidized developer scavenger didodecylhydroquinone at 0.054 g/m².

Layer 7: Slow Yellow Layer —— comprising blue-sensitized tabular silver bromoiodide grains (4.2 mole % I−) at 0.43 g/m², gelatin at 1.62 g/m², image-forming coupler J at 0.97 g/m², DIR coupler K at 0.043 g/m², bleach accelerator releasing coupler L at 0.022 g/m², and antifoggant 4-hydroxy-6-methyl-1,3,3a,7-tetraazaindene at 0.010 g/m².

Layer 8: Fast Yellow Layer —— comprising faster blue sensitized tabular silver bromoiodide grains (3.0 mole % I−) at 0.81 g/m², gelatin at 1.21 g/m², image-forming coupler J at 0.17 g/m², DIR coupler K at 0.032 g/m², and antifoggant 4-hydroxy-6-methyl-1,3,3a,7-tetraazaindene at 0.013 g/m².

Layer 9: Protective Overcoat and UV Filter Layer —— comprising gelatin at 1.22 g/m², unsensitized silver bromide, Lippmann emulsion at 0.11 g/m², UV absorber filter dyes, UV-1 at 0.11 g/m² and UV-2 at 0.12 g/m², anti-matte polymethylmethacrylate beads at 0.054 g/m² and hardener H-1 added at 2.0% of total gelatin weight.

A comparative control color negative photographic recording element that was known to produce ISO 400 speed was prepared in an analogous fashion by coating these layers in the order indicated on cellulose acetate support. This comparative control was designated Element IV.

ELEMENT IV
CONTROL

Layer 1: Antihalation Layer —— Comprising gray colloidal silver sol at 0.22 g/m², gelatin at 2.44 g/m², permanent cyan dye CD-1 at 0.040 g/m², permanent magenta dye MD-1 at 0.013 g/m², and ultraviolet dye UV-1 at 0.075 g/m².

Layer 2: Slow Cyan Layer ——comprising a blend of three red-sensitized silver bromoiodide grains, a medium size tabular grain emulsion (6.0 mole % I−) at 0.87 g/m², a smaller tabular grain emulsion (3.0 mole % I−) at 0.36 g/m², and a non-tabular grain emulsion (4.8 mole % I−) at 1.18 g/m², gelatin at 2.86 g/m², cyan image-forming coupler A at 0.67 g/m², DIR coupler B at 0.059 g/m², masking coupler C at 0.048 g/m², bleach accelerator releasing coupler D at 0.075 g/m², and antifoggant 4-hydroxy-6-methyl-1,3,3a,7-tetraazaindene at 0.078 g/m².

Layer 3: Fast Cyan Layer —— comprising faster red-sensitized tabular silver bromoiodide grains (6.0 mole % I−) at 1.29 g/m², gelatin at 1.83 g/m², cyan image-forming coupler E at 0.13 g/m², DIR coupler B at 0.059 g/m², masking coupler C at 0.037 g/m², bleach accelerator releasing coupler D at 0.043 g/m², and antifoggant 4-hydroxy-6-methyl-1,3,3a,7-tetraazaindene at 0.042 g/m².

Layer 4: Interlayer —— comprising gelatin at 1.29 g/m² and permanent dye YD-1 at 0.038 g/m².

Layer 5: Slow Magenta Layer —— comprising a blend of three green-sensitized silver bromoiodide grains, a medium size tabular grain silver bromoiodide emulsion (3.0 mole % I−) at 0.17 g/m², a smaller tabular grain silver bromoiodide emulsion (3.0 mole % I−) at 0.33 g/m², and non-tabular silver bromoiodide emulsion (4.8 mole % I−) at 1.09 g/m², gelatin at 2.39 g/m², image-forming coupler G at 0.74 g/m², DIR coupler I at 0.010 g/m², masking coupler H at 0.12 g/m², and antifoggant 4-hydroxy-6-methyl-1,3,3a,7-tetraazaindene at 0.026 g/m².

Layer 6: Fast Magenta Layer —— comprising faster green-sensitized tabular silver bromoiodide grains (6.0 ,mole % I−) at 1.25 g/m², gelatin at 1.82,g/m², image-forming coupler G at 0.22 g/m², DIR coupler I at 0.011 g/m², masking coupler H at 0.027 g/m², and antifoggant 4-hydroxy-6-methyl-1,3,3a,7-tetraazaindene at 0.015 g/m².

Layer 7: Yellow Filter Layer —— comprising gelatin at 1.29 g/m², Cary Lea silver at 0.022 g/m².

Layer 8: Slow Yellow Layer —— comprising a three-emulsion blend of medium size blue-sensitized tabular silver bromoiodide grains (6.0 mole % I−) at 0.25 g/m², smaller tabular silver bromoiodide grains at 0.25 g/m² (3.0 mole % I−), and substantially smaller tabular silver bromoiodide grains (3.0 mole % I−) at 0.16 g/m², gelatin at 2.45 g/m², image-forming coupler M at 1.38 g/m², DIR coupler N at 0.075 g/m², and antifoggant 4-hydroxy-6-methyl-1,3,3a,7-tetraazaindene at 0.011 g/m².

Layer 9: Fast Yellow Layer —— comprising faster blue-sensitized low aspect ratio silver bromoiodide grains (9.0 mole % I−) at 0.78 g/m², gelatin at 1.60 g/m², image-forming coupler M at 0.24 g/m², and antifoggant 4-hydroxy-6-methyl-1,3,3a,7-tetraazaindene at 0.013 g/m².

Layer 10: UV Filter Layer ——comprising gelatin at 0.54 g/m², silver bromide Lippmann emulsion at 0.22 g/m², UV filter dyes UV-1 at 0.11 and UV-2 at 0.12 g/m².

Layer 11 Protective Overcoat Layer ——comprising gelatin at 0.88 g/m², anti-matte polymethylmethacrylate beads at 0.063 g/m², and hardener H 1 at 2.0% of total gelatin weight.

STRUCTURES

Coupler A

-continued
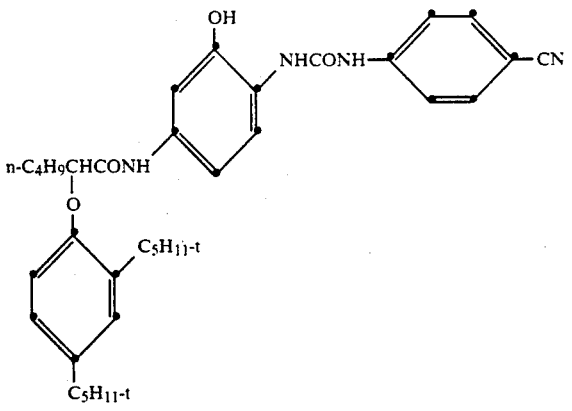
Coupler B
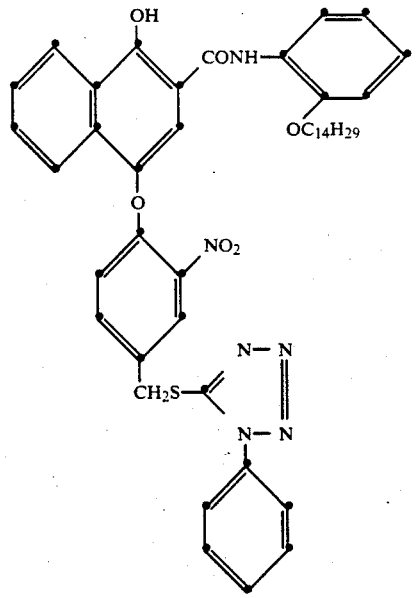
Coupler C
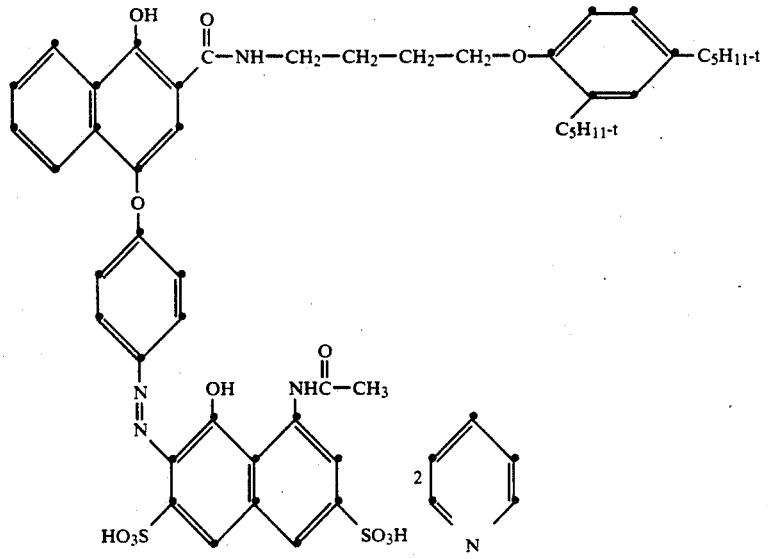
Coupler D

-continued
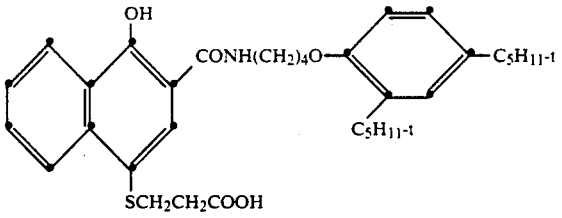
Coupler E
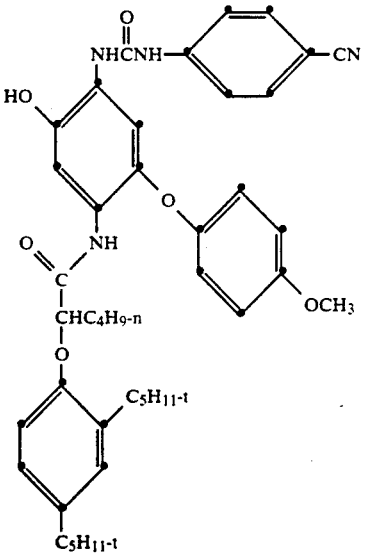
Coupler F
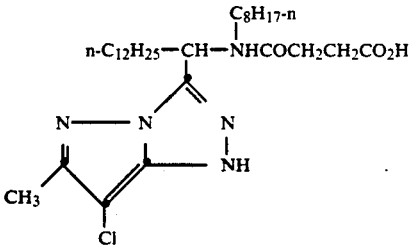
Coupler G
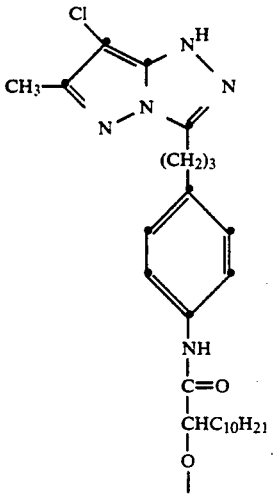

-continued
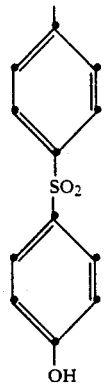
Coupler H
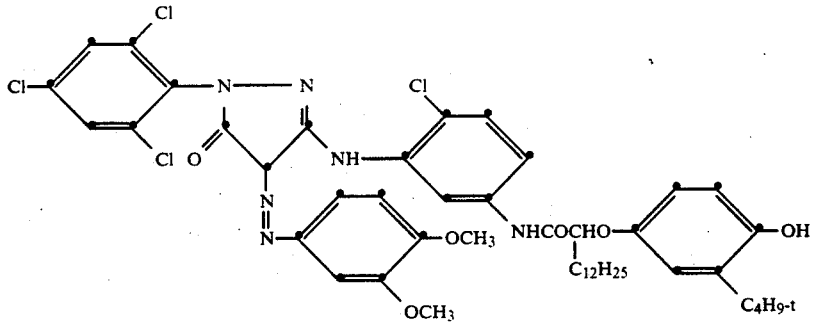
Coupler I
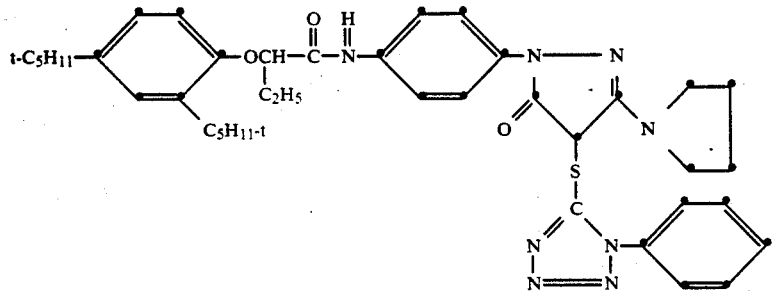
Coupler J
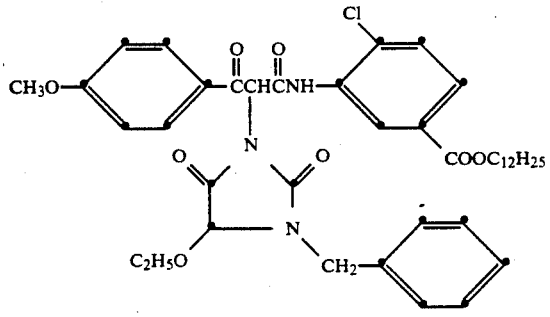
Coupler K -continued
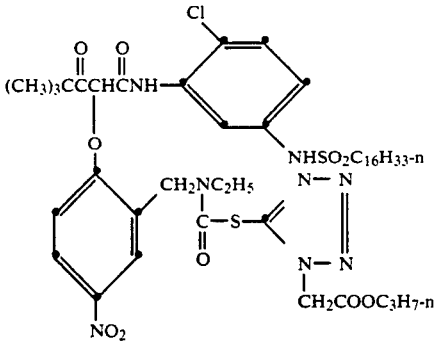
Coupler L
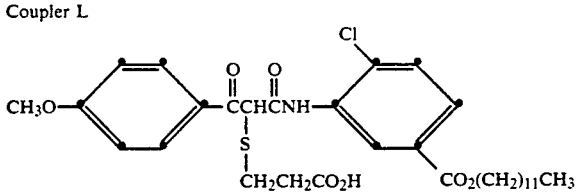
Coupler M
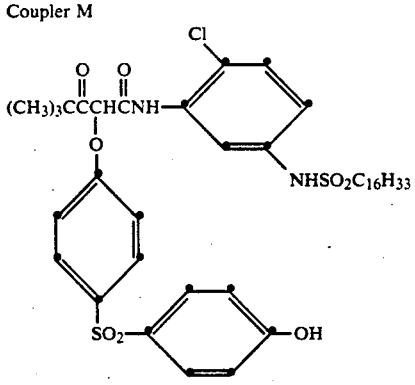
Coupler N
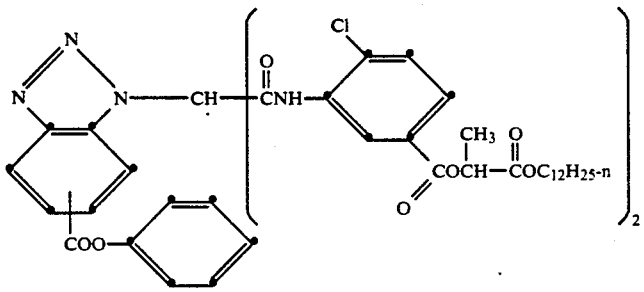
YD-1
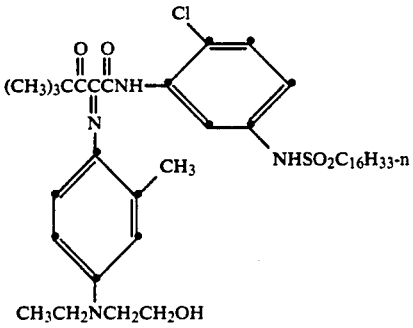
CD-1

-continued

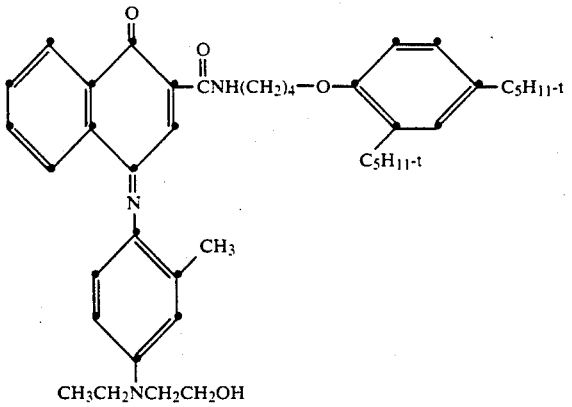

MD-1

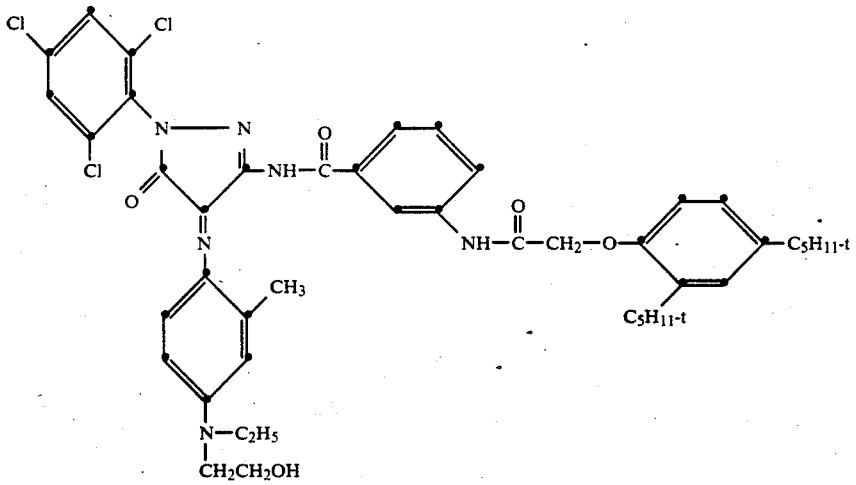

UV-1

$(C_6H_{13})_2-N-CH=CH-CH=C(CN)_2$

UV-2

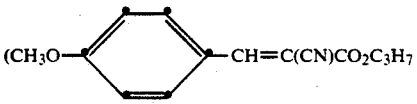

H-1

$CH_2(SO_2-CH=CH_2)_2$

H-2

$O(CH_2SO_2CH=CH_2)_2$

The color photographic light-sensitive materials, in the form of strips that were 305 mm long and 35 mm wide, were given a suitable exposure to light and then processed by contacting the materials sequentially with processing solutions as follows:

PROCESSING SEQUENCE

| | Processing Sequence | | | |
|---|---|---|---|---|
| Process | Process time sec. | Process Temp. °F. | Process Solution Volume, L | Agitation Type |
| Color Development | 195 | 100 | 8 | 1 |
| Bleaching | 240 | 100 | 8 | 2 |
| Water Wash | 180 | 95 | 8 | 3 |
| Fixing | — | 100 | 8 | 2 |
| Water Wash | 180 | 95 | 8 | 3 |

-continued

| | Processing Sequence | | | |
|---|---|---|---|---|
| Process | Process time sec. | Process Temp. °F. | Process Solution Volume, L | Agitation Type |
| Stabilization | 60 | 100 | 8 | 4 |

The type of agitation used in the processing solutions is as follows:

1) The solution was agitated by the intermittent introduction of nitrogen gas bubbles through a perforated flat plate at the bottom of the solution tank. The bubbles were introduced for a 2 second interval once every 10 seconds.

2) The solution was continuously agitated by a constant flow of air bubbles through a perforated flat plate at the bottom of the solution tank.
3) The solution was agitated by the constant flow of fresh water into the bottom of the tank, with the overflow going to a drain.
4) The solution was quiescent, and received no agitation.

The time of fixing was intentionally varied for the materials processed, in order to determine the minimum time required to fix the film satisfactorily.

After processing, the photographic materials were then dried in a drying chamber with gentle air circulation at approximately 90° F. for approximately 20 minutes.

The composition of each processing solution (each is an aqueous solution) is as follows:

| Component | Concentration |
|---|---|
| **Color Developer** | |
| Potassium carbonate | 34.30 g/L |
| Potassium bicarbonate | 2.32 g/L |
| Sodium sulfite | 0.38 g/L |
| Sodium metabisulfite | 2.78 g/L |
| Potassium iodide | 1.20 mg/L |
| Sodium bromide | 1.31 g/L |
| Diethylenetriaminepentaacetic acid. pentasodium salt | 3.37 g/L |
| Hydroxylamine sulfate | 2.41 g/L |
| 4-(N-ethyl-N-(2-hydroxyethyl)-amino)-2-methylaniline sulfate | 4.52 g/L |
| pH | 10.0 |
| **Bleach** | |
| Ammonium bromide | 50.0 g/L |
| 1,3-Diaminopropanetetraacetic acid | 30.3 g/L |
| Ferric nitrate nonahydrate | 36.4 g/L |
| 28% aqueous ammonia | 35.2 g/L |
| Glacial acetic acid | 26.5 g/L |
| 1,3-Diamino-2-hydroxypropane-N,N,N',N'-tetraacetic acid | 1.0 g/L |
| Ferric ammonium ethylenedinitrilotetra-acetate | 65.6 g/L |
| Ethylenedinitrilotetraacetic acid | 5.2 g/L |
| pH | 5.3 |

| | Fixer Baths | | |
|---|---|---|---|
| | I (Control) | II (Invention) | III (Invention) |
| Ammonium Thiosulfate | 0.825 M | 0.413 M | — |
| Sodium Thiosulfate | — | 0.412 M | 0.825 M |
| Ammonium Sulfite | 0.075 M | 0.038 M | — |
| Sodium Bisulfite | 0.125 M | 0.163 M | 0.20 M |
| Total Ammonium | 1.80 M | 0.90 M | 0 M |
| pH (adjusted with ammonium hydroxide or sodium hydroxide) | 6.5 | 6.5 | 6.5 |

STABILIZATION SOLUTION

PHOTO-FLO 200 solution (manufactured by Eastman Kodak Company) 5.0 mL/L

During fixing, samples of each coating were removed at periodic time intervals from the fixer baths, and were then washed, stabilized, and dried. The silver remaining in the coatings was measured with X-ray fluorescence technique. Coatings were considered satisfactorily fixed when no more than about 0.09 g/m$^2$ of silver remained. The fixing time was determined by interpolating between fixing times at which the coating contained more than 0.09 g/m$^2$ of silver and fixing times when the coating contained less than 0.09 g/m$^2$ of silver.

The fixing performance results are recorded in Table I for each element combined with fixing in the inventive fixer bath compositions and the comparative control fixer bath composition Fixing performance is recorded both as fixing time itself and as the amount of silver halide remaining, expressed as silver, after residence in the indicated fixer bath for the specified period of time.

Dramatic improvement of the rate of fixing by the inventive multicolor photographic recording materials is shown in the fixer baths of the invention, while providing reduced ammonium usage that confers waste disposal benefits.

As further illustration of the surprising ability of high tabularity emulsions to improve photographic recording material fixability, particularly under the conditions of reduced fixer efficacy when the ammonium content of the fixer bath is lowered even to the point of its complete elimination and the emulsions contain significant fractions of iodide, a series of nine different silver halide photographic coatings was prepared. The series comprised silver bromide and silver bromoiodide emulsions of approximately the same iodide content, wherein the physical properties varied (four within and five outside the invention), having approximately the same surface area per grain to obtain equal spectrally-sensitized speed. Each of the coatings was subjected to fixing in two fixer baths, one of the invention containing ammonium at 0.18 M, and one of the invention containing no ammonium at all. The photographic recording materials were prepared by coating the following layers in order, on a cellulose acetate film support.

TABLE I

MULTICOLOR RECORDING MATERIAL FIXING PERFORMANCE

| | | | Fixing Time (seconds) | | | Retained Silver (g/m$^2$) | | |
|---|---|---|---|---|---|---|---|---|
| | Silver Coverage (g/m$^2$) | Iodide Coverage (g/m$^2$) | Fixer I (Con) | Fixer II (Inv) | Fixer III (Inv) | After 30 s Fixer I (Con) | After 40 s Fixer II (Inv) | After 60 s Fixer III (Inv) |
| Element I (Invention) | 2.85 | 0.12 | 10 | 10 | 17 | 0.03 | 0.01 | 0.02 |
| Element II (Invention) | 5.97 | 0.26 | 30 | 36 | 49 | 0.08 | 0.04 | 0.03 |
| Element III (Invention) | 6.79 | 0.27 | 32 | 39 | 58 | 0.10 | 0.04 | 0.04 |
| Element IV (Control) | 8.68 | 0.47 | 58 | 69 | 114 | 1.4 | 1.05 | 2.33 |

ELEMENTS A–I

Layer 1: Silver Halide Emulsion Layer —— comprising one of the nine silver bromide or silver bromoiodide emulsions characterized in Table II at approximately 4.31 g/m$^2$ of silver, and gelatin at 15.1 g/m$^2$.

Layer 2: Protective Overcoat —— comprising gelatin at 1.08 g/m$^2$ with 1.75% by weight to total gelatin of hardener H 2.

The coatings were processed as indicated below.

| Process Sequence | | | | |
|---|---|---|---|---|
| Process Step | Process Time, sec | Process Temp, °F. | Process Solution Volume, L | Agitation Type |
| Tap Water Presoak | 10 min 15 sec | 95 | 8 | 1 |
| Fix (time series) | 5–10 sec intervals | 100 | 8 | 2 |
| Tap Water Wash | 3 min | 95 | 8 | 1 |
| Stabilize | 1 min | 100 | 8 | 3 |

The type of agitation used in the processing solutions is as follows:

1) The solution was agitated by the constant flow of fresh water into the bottom of the tank, with the overflow going to a drain.
2) The solution was agitated by a constant flow of air bubbles through a perforated flat plate at the bottom of the solution tank.
3) The solution was quiescent and received no agitation.

| Fixer Bath Composition | | |
|---|---|---|
| Fixer Baths | IV (Invention) | V (Invention) |
| Ammonium Thiosulfate | 0.0825 M | — |
| Sodium Thiosulfate | — | 0.0825 M |
| Ammonium Sulfite | 0.0075 M | — |
| Sodium Bisulfite | 0.0125 M | 0.02 M |
| Ammonium Ion Concentration | 0.18 M | 0.00 M |
| pH (adjusted with sodium hydroxide) | 6.5 | 6.5 |

STABILIZER BATH

The stabilizer processing solution contained 5 mL of PHOTO-FLO 200 solution (manufactured by Eastman Kodak Company) per litre of tap water.

During fixing, samples of each coating were removed at controlled time intervals (5 to 10 second intervals depending on the rate of fixing), then washed, stabilized, and dried The silver remaining in the coatings was measured by X-ray fluorescence. Coatings can be considered to be satisfactorily fixed when no more than about 0.09 g/m$^2$ of silver remains. The fixing time was estimated by interpolating between fixing times at which the coating contained more than 0.09 g/m$^2$, of silver and fixing times at which the coating contained less than 0.09 g/m$^2$ of silver.

The results are listed in Table II for each coating.

TABLE II

PHYSICAL DESCRIPTION OF EMULSIONS AND FIXING PERFORMANCE

| | Silver Coverage (g/m$^2$) | Iodide Coverage (g/m$^2$) | Grain Surface Area (μm$^2$/grain) | — T | Fixing Time (seconds) Fixer IV (Inv) | Fixer V (Inv) |
|---|---|---|---|---|---|---|
| Element A (Control) | 4.06 | 0 | 66.2 | 1 | 149 | 205 |
| Element B (Control) | 4.59 | 0 | 16.8 | 1 | 147 | 188 |
| Element C (Control) | 4.39 | 0 | 3.8 | 1 | 131 | 155 |
| Element D (Inv.) | 4.28 | 0 | 10.0 | 734 | 129 | 145 |
| Element E (Control) | 4.19 | 0.08 | 4.5 | 1 | 187 | 300 |
| Element F (Inv.) | 4.32 | 0.10 | 19.2 | 340 | 175 | 261 |
| Element G (Control) | 4.19 | 0.20 | 11.0 | 1 | 277 | 467 |
| Element H (Inv.) | 4.22 | 0.16 | 12.9 | 185 | 206 | 305 |
| Element I (Inv.) | 4.32 | 0.16 | 14.1 | 376 | 209 | 318 |

The data in Table II show that in every circumstance of equivalent silver halide composition, the tabular grain emulsions provide improved fixing over low aspect ratio grain emulsions, particularly as the fixer efficacy is encumbered by the removal of ammonium and by the introduction of greater amounts of iodide into the emulsion.

The invention has been described in detail with reference to preferred embodiments thereof, but it will be understood that variations and modifications can be effected within the spirit and scope of the invention.

What is claimed is:

1. An image forming process for a color negative recording material comprising a support and at least one silver halide emulsion imaging unit sensitive to a region of the electromagnetic spectrum, said unit containing a dye-forming coupler, and at least one high tabularity silver halide emulsion sensitive to light, wherein:

a) said unit contains from about 0.2 to 3.0 g/m$^2$, based on silver, of a silver halide emulsion in which greater than 50% of the projected surface area is provided by tubular grains having a tabularity between 50 and 25,000;

b) said unit has an iodide content between 0 and 40 mole percent;

c) said color recording material has a silver halide content of less than about 7.0 g/m$^2$, based on silver;

d) said color recording material has an iodide content of less than about 0.35 g/m$^2$;

e) said color recording material has a positive contrast of 0.9 or less when the recording material is exposed and processed;

said process comprising subjecting said color negative recording material to color development and subsequently fixing the developed material in a fixer bath which has a thiosulfate concentration from about 0.05 to about 3.0 molar and has an ammonium concentration of 0.0 to about 1.2 molar.

2. The process of claim 1 wherein the high aspect ratio tabular grain emulsion has a tabularity between about 100 and 10,000.

3. The process of claim 1 in which the silver halide content of the recording material contains from about 1.0 to about 4.3 g/m$^2$ of silver halide expressed as silver.

4. The process of claim 1 in which the tabular grains comprise at least one of silver bromide or silver bromoiodide.

5. The process of claim 1 wherein the ammonium concentration is less than about 0.9 molar.

6. The process of claim 1 wherein ammonium is essentially absent.

7. The image forming process of claim 1 in which the fixing step is performed for less than about 270 seconds.

* * * * *